United States Patent [19]

Gagnon

[11] Patent Number: 4,579,237

[45] Date of Patent: Apr. 1, 1986

[54] BOTTLE CAP AND HANDLE ASSEMBLY

[76] Inventor: Paul L. Gagnon, 3714 Via Pacifica Walk, Oxnard, Calif. 93030

[21] Appl. No.: 726,762

[22] Filed: Apr. 24, 1985

[51] Int. Cl.[4] ..... B65D 45/32

[52] U.S. Cl. ..... 215/100 A

[58] Field of Search ..... 215/100 A, 320, 317

[56] References Cited

U.S. PATENT DOCUMENTS

| | | | |
|---|---|---|---|
| D. 277,080 | 1/1985 | Gagnon . | |
| 2,814,404 | 11/1957 | Towns | 215/320 |
| 3,066,820 | 12/1962 | Faulstich . | |
| 3,155,263 | 11/1964 | Hidding | 215/100 A |

*Primary Examiner*—Donald F. Norton

*Attorney, Agent, or Firm*—Kenneth J. Hovet

[57] ABSTRACT

A bottle cap having sidewalls that extend over the recessed neck area of a five gallon water bottle in combination with a handle having a bottleneck engagement cradle. The cradle encompasses portions of the cap sidewalls when positioned about the neck recess. When the water bottle is lifted by the handle, the cap sidewalls will be pressed against the neck recessed area. The cap includes an inner ring that abuts against the inner surfaces of the bottle opening and prevents distortion of the neck during lifting of the bottle.

10 Claims, 5 Drawing Figures

BOTTLE CAP AND HANDLE ASSEMBLY

BACKGROUND OF THE INVENTION

1. Field of the Invention

The present invention relates to heavy bottle handling and, more particularly, to means for capping and carrying large narrow-necked water bottles.

2. Description of the Prior Art

Currently more and more households have begun consuming bottled water because of the desire for pure clean water. Such water is commonly delivered to homes in plastic five gallon bottles that weigh over forty-two pounds when full. It is therefore incumbent to find ways to facilitate the handling of such bottles and to maintain the water free of contaminants.

Generally, the aforementioned bottles are provided with a plastic cap which covers the bottle opening and encompasses the top rim portion. Such caps are shown and described in U.S. Pat. No. 3,066,820. These caps work well if the bottle is simply lifted by hand about the neck flange or about the neck and bottom areas.

Unfortunately, workmen delivering larger numbers of bottles to households and commercial establishments have experienced a high frequency of hand, wrist and arm disablements. For this reason, applicant devised a reinforced handle similar to that shown in U.S. Pat. No. Des. 277,080. This handle has a cradle portion with an opening that closely fits around the bottle recessed neck area and engages the neck flange when lifted. This greatly relieves stress on workmen's hands, wrists and arms and contributes to a safer work environment.

However, when the sealed bottle cover is removed and the prior art temporary cap is in place, the aforementioned handle will dislodge the cap during lifting of the bottle. This is caused by the handle cradle pushing up against the end of the tapered up skirt. It was also caused by distortion of the bottleneck area.

It will be appreciated that present day five gallon water bottles are constructed of resilient thin-walled plastic. Although the plastic is strong, it does flex under stress. When the bottle weight is shifted to the neck area during handle lifting, the neck region flexes causing the prior art caps to pop-off. In fact, the inner ring of the cap shown in U.S. Pat. No. 3,066,820 exacerbates the problem since it becomes pinched and creates additional force to pop the cap.

SUMMARY OF THE INVENTION

The invention comprises a unique combination of cap and handle for flange-necked bottles. It provides a means for carrying the heavy bottles that are heavily laden with liquids such as water while affirmatively maintaining a protective cap over the bottle opening.

The cap includes sidewalls extending across the annular bottleneck recess. It also includes an inner ring for inhibiting distortion during lifting. The handle has a tapered bottleneck engagement opening adapted to fit over the recess and sidewalls and engage the bottle rim underside during lifting.

DESCRIPTION OF THE PREFERRED EMBODIMENTS

Figure 1:
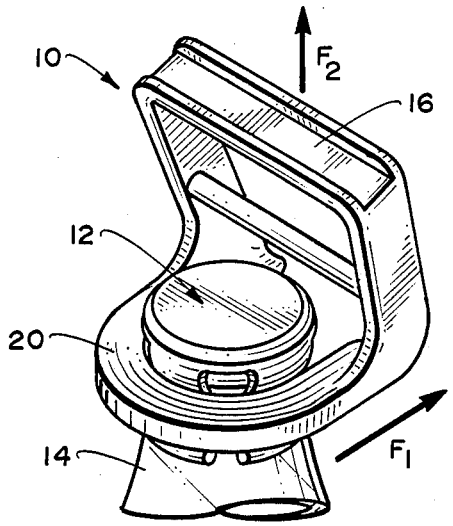
FIG. 1 is a perspective view of the combination cap and handle in lifting position on a fragmentary water bottleneck.

With reference now to the drawings and, more particularly to FIG. 1 thereof, the combination handle 10 and bottlecap 12 assembly is shown in position for lifting a bottle shown in fragment by reference number 14. The handle includes a grasping bar 16 having opposing side-members 18, 19 connected to a bottleneck engagement member or cradle 20. Because the bottles being lifted frequently weight in excess of 40 pounds, it is desireable to include cross-member 21 to support and reinforce the handle. The cross-member provided is attached to the inner mid-point surfaces of the opposing side-members 18 and 19 and provides lateral support therefore.

Figure 2:
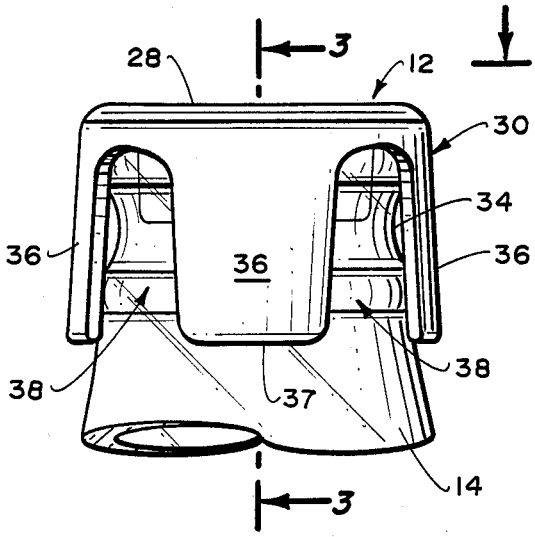
FIG. 2 is a side elevation view of the cap of the invention on the neck of a bottle shown in fragment.
Figure 3:
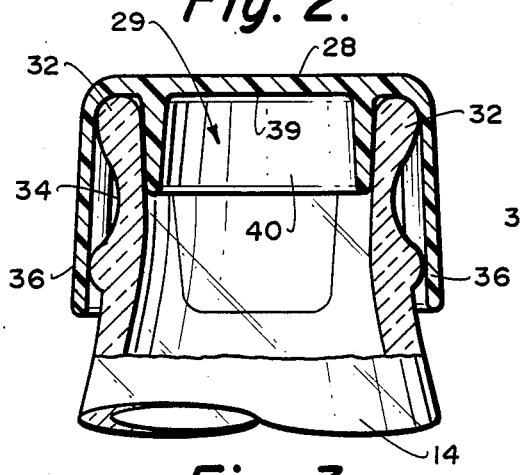
FIG. 3 is a cross-sectional view taken along lines 3—3 of FIG. 2.

The cradle portion of the handle has a front opening 22 having a width $W_1$ that tapers inwardly to a closed end portion 24 having a smaller width $W_2$. The front opening width is sufficient to encompass the cap sidewalls 30 in their normal unflexed posture as shown in FIGS. 2 and 3.

The closed end portion width must be less than the width of the enlarged bottle rim 32 and slightly greater than the width of bottleneck annular recess 34 plus about twice the thickness of the bottle cap sidewalls 30. As shown, end 24 defines a circular segment having a radius $R_2$ which is about equal to the radius $R_1$ of the annular recess 34 plus the thickness of sidewall 36. Preferably, the inner and upper surfaces 26 of the neck engagement member 20 are curved to facilitate engagement of the handle with the cap and bottleneck.

Bottle cap 12 includes topwall 28 that overlies the bottleneck opening 29. As shown, the topwall is flat and circular in plan with sidewalls or skirt 30 extending downwardly from the periphery thereof. An essential feature of the invention is that the sidewalls extend across bottleneck annular recess 34 for a purpose to be hereinafter described.

It is expected that the sidewall will include at least two opposing segments for effective contact with opposing sides of engagement member 20. As shown in the drawings, four equally spaced-apart segments 36 are shown with corresponding open portions 38 between each segment.

The wall segments 36 are preferably uniform in thickness. As shown, they are arcuate in shape with rounded corners and terminate at straight bottom edge 37. The open portions are arch-shaped but could be narrow slit-like openings depending on the wall segment size and design. The walls must be flexible and non-corrosive and are preferably constructed of plastic materials.

Extending downwardly and about perpendicularly from the topwall underside 39 is inner support ring 40. The ring is positioned concentrically to the center axis of the cap and contacts the inside surface 41 of bottleneck rim 32. The ring renders support to the bottleneck opening 29 and inhibits distortion thereof during lifting of the bottle.

Figure 4:
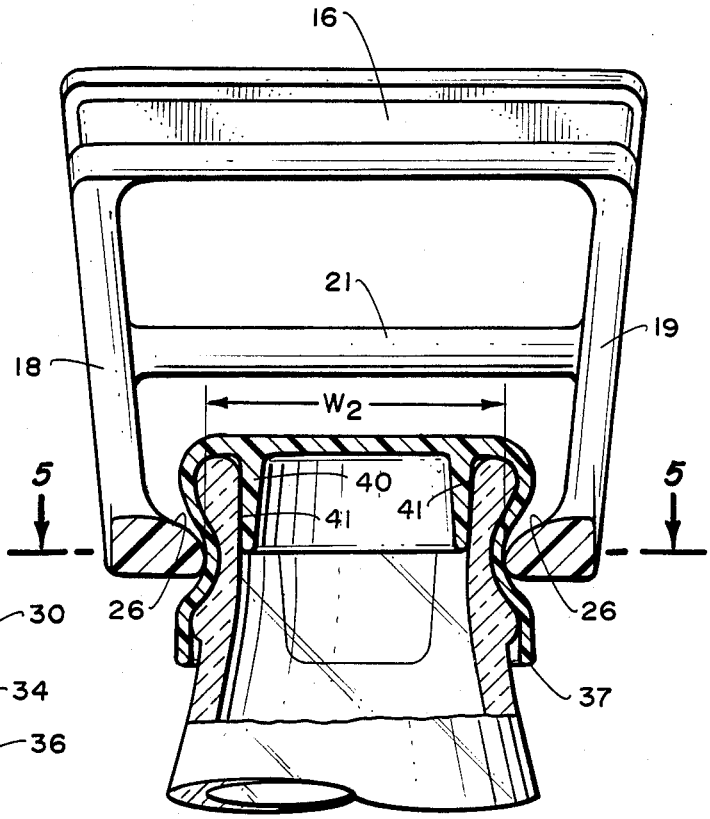
FIG. 4 is a cross-sectional view similar to FIG. 3 with the handle cradle shown in cross-section in position for lifting.
Figure 5:
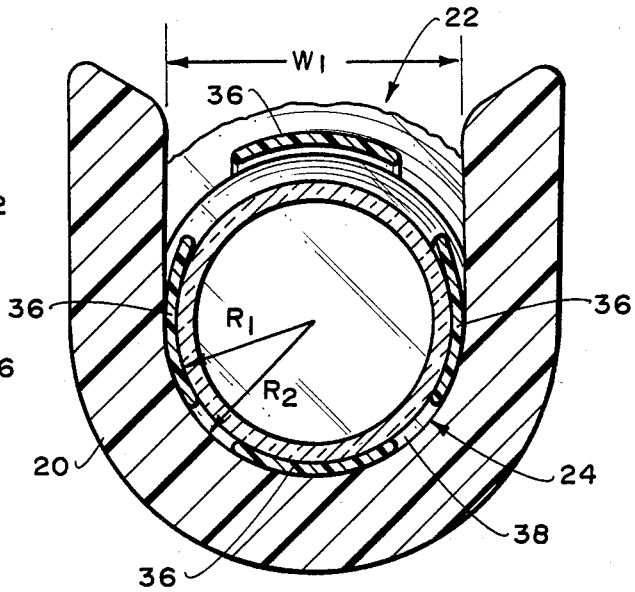
FIG. 5 is a cross-sectional view taken along lines 5—5 of FIG. 4.

In operation, a user will manually grasp handle 10 about bar 16 and direct handle opening 22 across the wall segments 36 in the direction shown by arrow $F_1$. As a result of the opening tapering inwardly to a lesser diameter $W_2$, the sidewall segments will become pinched inwardly and be forced against the annular recess 34 as best shown in FIG. 4. As so engaged a user may then impart an upwardly lifting force shown by arrow $F_2$ at which point the force will be transmitted through the cradle 20 to the skirt segments and underside of rim 32. In this manner the bottle may be lifted and suspended from the handle cradle and carried as desired.

With the skirt segments being securely pressed against the bottleneck, dislodgement is not possible and the opening will be affirmatively covered by the bottle cap. Release of the cradle from its engagement with the annular recess will allow the skirt segments to return to their original configuration as shown in FIG. 2. A user may then readily remove the cap for access to the bottle's contents.

It is expected that the bottle cap may be attached by wire, plastic or string attachment means known in the art to the carrying handle for repetitive use with water bottles.

While the invention has been described with respect to a preferred embodiment, it will be apparent to those skilled in the art that various modifications and improvements may be made without departing from the scope and spirit of the invention. Accordingly, it is to be understood that the invention is not to be limited by the aforementioned embodiment but only by the scope of the appended claims.

I claim:

1. A cap in combination with a portable handle for handling a bottle having a narrow-neck and top opening surrounded by an enlarged rim, said neck including an annular recess below said rim comprising:

a cap positioned over said opening having a top wall from which extends a sidewall, said sidewall overlying said annular recess at least on opposing sides thereof; and, a handle having a grasping bar connected to a bottleneck engagement member, said member having a U-shape with an opening having a width less than the diameter of the enlarged rim and greater than the diameter of the annular recess plus about twice the thickness of said sidewall, said member in engagement with at least a portion of the annular recess with said sidewall therebetween.

2. The combination of claim 1 wherein said opening tapers inwardly to a curved end portion.

3. The combination of claim 2 wherein said end portion has a radius of curvature about equal to the radius of said annular portion plus the thickness of the sidewall.

4. The combination of claim 1 wherein said sidewall comprises two or more segments.

5. The combination of claim 4 wherein the sidewalls include open portions between said segments.

6. The combination of claim 4 including an inner ring extending downwardly from the underside of said top wall in contact with the inside surface of the neck defining said top opening.

7. A cap and handle lifting assembly for narrow-necked bottles having an enlarged ring about the bottle top opening with an annular recess therebelow comprising:

a cap covering the opening having a skirt that extends below said recess and a handle having a cradle part that contacts opposing portions of the skirt and presses said portions against said annular recess when a lifting force is imparted to the handle.

8. The assembly of claim 7 wherein the cradle part has a front opening that tapers inwardly to a closed end having a width less than the diameter of said rim.

9. The assembly of claim 8 including a support ring depending from the underside of said cap and spaced concentrically from said skirt a distance about equal to the thickness of said rim.

10. The assembly of claim 8 wherein said skirt comprises at least two opposing segments.

* * * * *